United States Patent [19]

Walczak et al.

[11] Patent Number: 5,051,175

[45] Date of Patent: Sep. 24, 1991

[54] DRAIN GUARD

[75] Inventors: Thomas W. Walczak, Norfolk; Robert M. Bennette, Millis, both of Mass.

[73] Assignee: Roof Accessories, Inc., Norfolk, Mass.

[21] Appl. No.: 453,508

[22] Filed: Dec. 20, 1989

[51] Int. Cl.[5] ..... B01D 35/02

[52] U.S. Cl. ..... 210/166; 210/462; 52/12; 52/15; 285/42

[58] Field of Search ..... 210/163, 166, 462, 498; 52/12, 15; 285/42

[56] References Cited

U.S. PATENT DOCUMENTS

| | | | |
|---|---|---|---|
| 528,888 | 11/1894 | McGill | 210/166 |
| 1,252,548 | 1/1918 | Carlson | 285/42 |
| 1,593,550 | 7/1926 | Holt | 210/166 |
| 1,761,257 | 6/1930 | Fleming | 210/166 |
| 2,807,368 | 9/1957 | Blau | 210/463 |
| 3,121,682 | 2/1964 | Alberico | 210/166 |
| 3,517,813 | 6/1970 | Thaler | 210/166 |
| 4,035,297 | 7/1977 | Aldridge et al. | 210/163 |
| 4,107,929 | 8/1978 | Ebeling et al. | 52/12 |
| 4,418,432 | 12/1983 | Vidal | 4/286 |

FOREIGN PATENT DOCUMENTS

| | | |
|---|---|---|
| 014642 | 1/1904 | Austria . |
| 203508 | 2/1907 | Fed. Rep. of Germany . |
| 211202 | 11/1908 | Fed. Rep. of Germany . |
| 1006833 | 4/1957 | Fed. Rep. of Germany . |
| 35134 | 7/1965 | Finland . |

*Primary Examiner*—Stanley Silverman
*Assistant Examiner*—Christopher Upton
*Attorney, Agent, or Firm*—Gaston & Snow

[57] ABSTRACT

The invention includes a drain guard and drain protection system. The drain guard includes a cross-sectionally L-shaped frame having a base and an upstanding sidewall extending therefrom. The upstanding sidewall has a plurality of spaced openings. The base may also have a plurality of spaced openings in communication with the plurality of spaced upstanding sidewall openings positioned relative thereto. The frame is of substantially greater perimeter than the perimeter of the enclosed drain opening. The drain protection system includes a surface layer having ballast spread therealong, a drain opening extending through the surface layer, a portion of the surface layer cleared of ballast, the portion outwardly extending from the drain opening to a drain guard of the above-described type.

4 Claims, 2 Drawing Sheets

DRAIN GUARD

FIELD OF INVENTION

The present invention relates to a drain guard and drain protection system and, more particularly, to a drain guard and drain protection system for roof drains.

BACKGROUND OF INVENTION

Flat roofs are typically equipped with one or more drains to remove precipitation and other water that collects on the roof surface. Rapid removal of such water is essential as its weight places great stress on a roof structure. If the weight of water on a roof reaches a sufficiently high amount, collapse of the roof structure can occur resulting in extensive property damage as well as grave injury to the building's occupants.

Drain strainers have been used to prevent the clogging of roof drains by leaves, trash, and other solid materials which deposit on a roof surface. These solid materials are readily carried to a drain opening by the force of draining water. One commonly used type of drain strainer consists of a domed-shaped housing perforated with spaced multiple openings. Placed over the mouth of a drain opening of approximately the same perimeter, this type of drain strainer filters the draining water by permitting the water to flow through the multiple openings while blocking solid materials being carried by the force of the draining water.

The shortcomings of this type of drain strainer are several-fold. Because the drain strainer's perimeter approximates that of the drain opening, its filtering capacity is limited. As a consequence, only a relatively small amount of solid materials need accumulate around the outer surface of the drain strainer for the multiple openings to become sealed, and water flow to the drain opening thereby blocked. Once water flow is blocked, water will collect on the roof surface and pose the hazards of structural damage, including roof collapse, and bodily injury. Additionally, this type of drain strainer is often constructed of polyvinyl chloride or other polymer. Exposure to sunlight, temperature changes, and other weather conditions causes the polymer strainer to become brittle and weakened. Consequently, the degraded polymer will eventually fracture. If used on a ballasted roof where roofing material is secured by stone or other ballast, fracturing of the weakened polymer drain strainer can occur much more readily because the surrounding ballast, by the force of draining water, repeatedly impacts the drain guard. Once fractured, solid materials being carried by the force of draining water freely pass into and soon clog the drain opening.

In U.S. Pat No. 3,121,682, auxiliary drain protector was disclosed surrounding a primary protector of lesser periphery. However, both the primary and auxiliary drain protectors only had uniformly spaced sidewall openings and hence did not provide enhanced flow of draining water to a drain opening.

SUMMARY OF THE INVENTION

The problems of the prior art are greatly resolved by the present invention which includes a drain guard and a drain protection system. In accordance with the invention, a drain guard is provided comprising a frame having a base and upstanding sidewall extending therefrom. The upstanding sidewall has a plurality of spaced openings with adjacent openings being vertically offset to optimize fluid flow. To facilitate drainage, the base may have a plurality of openings in communication with the openings in the upstanding sidewall positioned relative thereto. Alternatively, the plurality of spaced upstanding sidewall openings may uniformly extend to the junction of the base and upstanding sidewall and communicate with the plurality of spaced base openings. Also in accordance with the invention, a drain protection system is provided which includes a ballasted surface layer such as a roof, a drain opening extending through the surface layer, and a portion on the surface layer cleared of ballast outwardly extending from a drain opening to a drain guard.

It is a primary object of the present invention to provide a drain guard with a strainer design that promotes the flow of water to a drain opening.

It is a further object of the present invention to provide a drain guard that reduces the instances of drain clogging.

It is still another object of the present invention to provide a roof drain protection system that promotes the flow of water to a drain.

These and other features of the present invention will be more clearly understood by referring to the following detailed description together with the Drawing in which like reference numbers refer to like elements throughout the various figures.

DESCRIPTION OF THE PREFERRED EMBODIMENT

Figure 1:
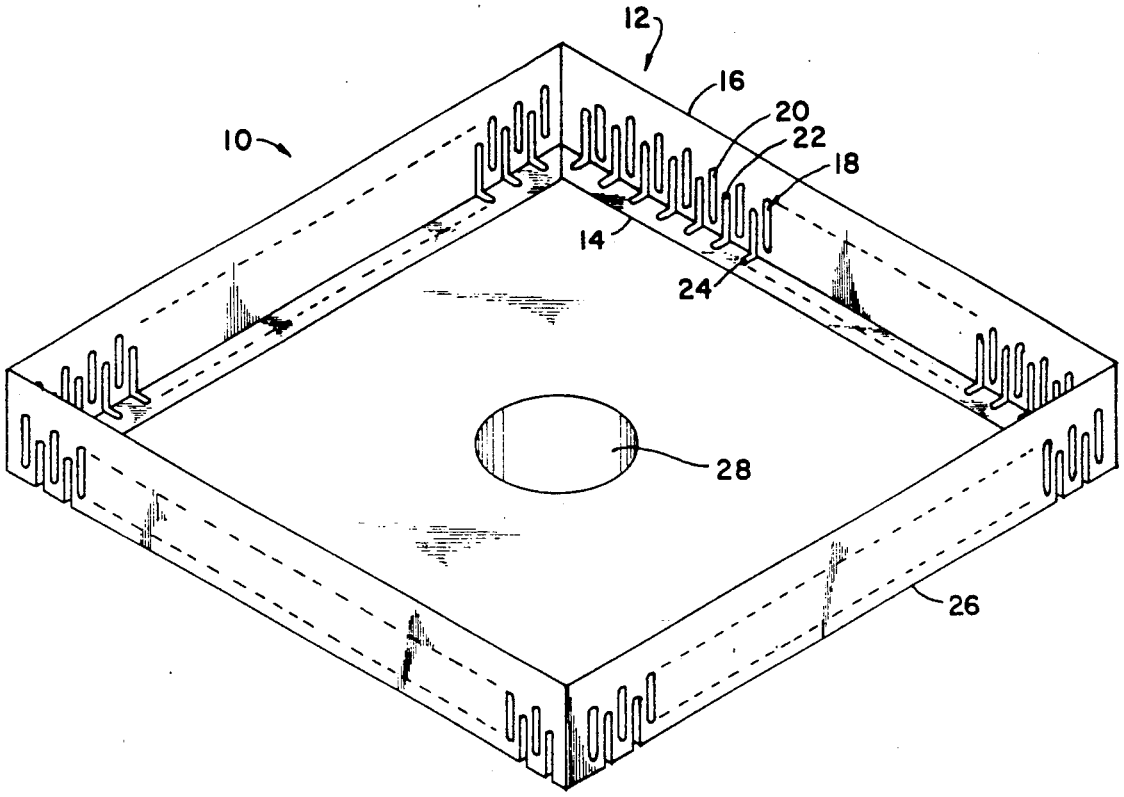
FIG. 1 is a plan view of the drain guard of the present invention.
Figure 2:
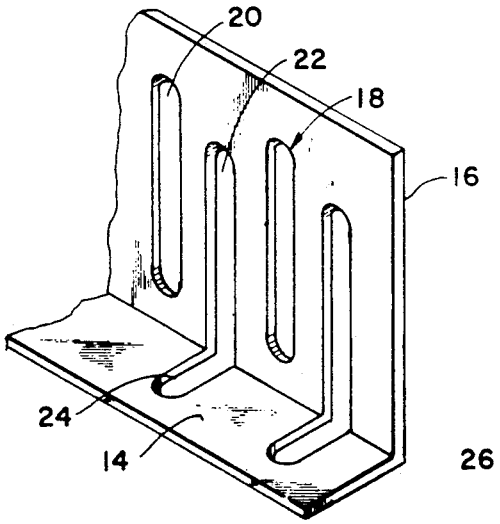
FIG. 2 is a sectional view taken substantially along the line 2—2 of FIG. 1.

In the preferred embodiment of the present invention as shown in FIG. 1 and FIG. 2 of the Drawing, the drain guard 10 includes a cross-sectionally L-shaped frame 12 having a base 14 and an upstanding sidewall 16 having a plurality of spaced openings 18 extending therethrough. Openings 18 are preferably oblong-shaped as such a configuration has been found to optimize fluid flow there through. Circular, rectangular and other opening shapes known to those in the art may also be utilized. Adjacent plurality of spaced openings 18 are vertically offset from one another as, for example, opening 20 is offset from opening 22. Alternating openings 18 are also preferably uniformly positioned and sized. The foregoing arrangements are believed to provide better drainage particularly at increased water levels while maintaining the necessary strength and integrity of the frame 12. The base 14 has a plurality of spaced openings 24 extending from the junction 26 of the base 14 and upstanding sidewall 16. The base openings 24 are in communication with the upstanding sidewall openings 18 positioned relative therewith. The perimeter of frame 12 is substantially greater than the perimeter of the drain opening 28. Preferably, the perimeter of the frame is at least sixteen times greater than the perimeter of the drain opening.

It has been found that by vertically offsetting the plurality of spaced openings 18 the flow rate of draining water through the drain guard 10 and to the drain opening 28 is enhanced relative to the flow rate through a system where the plurality of spaced upstanding sidewall openings are not so offset. By vertically offsetting the openings, a greater length of the upstanding sidewall has openings therethrough, and hence water of a greater depth can flow unimpeded through the drain guard.

Enhancing the flow of draining water through the drain guard is critical, particularly at times when the volume of draining water is large, for example during a severe rainstorm. If the rate of water accumulation on a roof is greater than the flow rate through the drain guard, water will accumulate placing hazardous stress on the roof structure.

Although each of the upstanding sidewall openings 18 may have a corresponding base opening 24 in communication therewith, it has also been found that by alternating the sidewall openings 18 so that every other sidewall opening 18 has an associated base opening 24 positioned thereto, the structural integrity of the drain guard is improved.

The base plurality of openings 24 are advantageous as water will accumulate on the roof surface only to a depth equal to the thickness of the base 14 before the water drains through the drain guard 10 and to the drain opening 28. Hence, only a negligible volume of water will accumulate on a roof before passing through the drain guard 10 and stress to the roof structure is thereby avoided.

The drain guard 10 is preferably constructed of 3.2 millimeter flat aluminum sheets, although other materials, such as other metals or a polymer, and other sheet dimensions should also provide an acceptable drain guard. The upstanding sidewall plurality of openings 18 and base plurality of openings 24 are mechanically stamped out of the flat aluminum sheets. The base 14 and upstanding sidewall 16 are then formed by folding the aluminum sheet along junction 26. The ends of the folded aluminum sheet are preferably mitered and then fastened by bolts, welding or other means known to those skilled in the art to the ends of like folded aluminum sheets to provide the frame 12.

Figure 3:
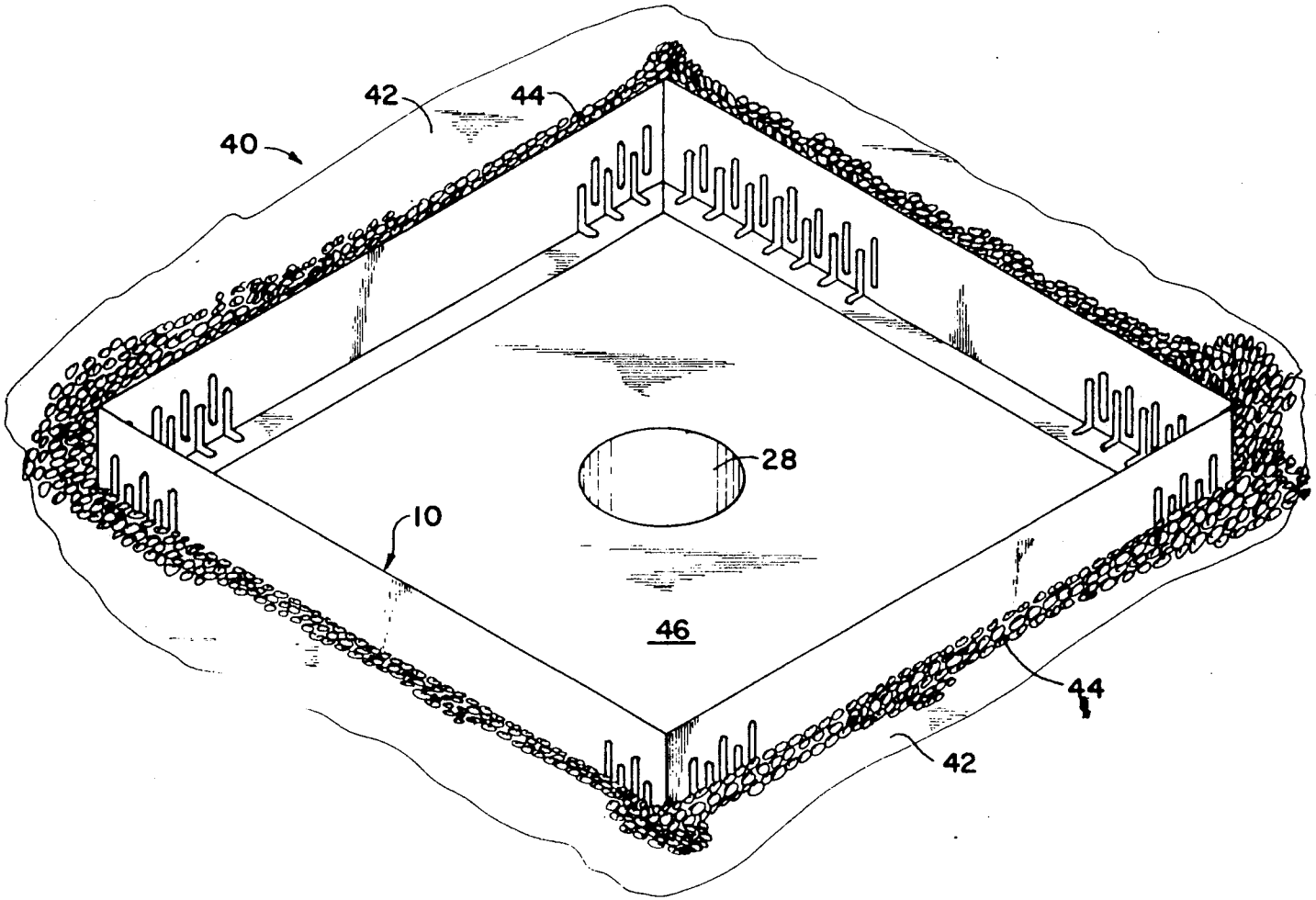
FIG. 3 is a plan view of the drain protection system of the present invention.

In another aspect of the preferred embodiment of the invention as shown in FIG. 3 of the Drawing, the drain protection system 40 includes a roof or other surface layer 42 having ballast 44 spread along the surface layer 42. The ballast 44 serves to secure the surface layer 42 to the underlying support member. A drain opening 28 extends through the surface layer 42 to receive draining water. A portion 46 of the surface layer 42 has been cleared of ballast, the portion 46 outwardly extending from the drain opening to the drain guard 10. The drain guard 10 is of the type described in reference to FIG. 1 and FIG. 2.

It has been found that removal of ballast 44 from portion 46 provides increased fluid flow of draining water to drain opening 28 relative to a similar system where ballast 44 has not been removed from portion 46. Again, by enhancing the flow of water through the drain protection system, accumulation of water on the roof is minimized, and stress on the roof structure is thereby avoided. The removal of ballast 44 from portion 46 also prevents ballast clogging the drain opening 28. Moreover, the weight of the drain guard 10 serves the purpose of the ballast removed from portion 46 by securing the surface layer 42 to the underlying support member.

A conventional drain strainer of approximately the same perimeter as the drain opening may be used in combination with the drain protection system 40. The drain protection system prevents ballast from collecting around the conventional drain strainer and thereby impeding water flow to the drain opening. Moreover, if the conventional drain strainer is of polymer construction, removal of the ballast 44 prevents the fracturing of a weakened polymer drain strainer resulting from impacting ballast.

It is to be understood that the preceding description is given merely by way of illustration and not in limitation of the invention and that various modifications may be made thereto without departing from the spirit of the invention as claimed.

What is claimed is:

1. A guard for a drain opening, said guard comprising:

an uncovered frame having a substantially L-shaped cross-section formed of an elongated base and an upstanding elongated flat sidewall integral therewith, said upstanding sidewall having a plurality of spaced-apart openings extending therethrough, the openings of a first group of said plurality of spaced-apart openings being vertically offset from the respective openings of a second group of said plurality of spaced openings, and said frame having a greater perimeter than the perimeter of said drain opening.

2. A guard for a drain opening as defined in claim 1 wherein said openings of said first group are disposed in alternating relation with said openings of said second group.

3. A guard for a drain opening as defined in claim 2 wherein one of said groups of said plurality of spaced upstanding sidewall openings extend downwardly to the junction of said base and upstanding sidewall.

4. A drain protection system, comprising:

a surface layer having ballast spread therealong, a drain opening extending through said surface layer, an uncovered drain guard frame surrounding said drain opening, said surface layer having a portion thereof cleared of said ballast, said portion extending from said drain opening to said drain guard frame, said drain guard frame including a substantially L-shaped cross-section formed of an elongated base and an upstanding elongated flat sidewall integral therewith, said upstanding sidewall having a plurality of spaced-apart openings extending therethrough, alternate ones of said plurality of spaced-apart openings being vertically offset from one another, said drain guard frame having a greater perimeter than the perimeter of said drain opening.

* * * * *